United States Patent [19]

Lechner

[11] Patent Number: 4,984,747

[45] Date of Patent: Jan. 15, 1991

[54] CHOPPING- AND SLICING MACHINE

[76] Inventor: Magister H. Lechner, Kaiseraufstieg 30, A-6330 Kufstein/Ebbs, Austria

[21] Appl. No.: 363,677

[22] Filed: Jun. 9, 1989

[30] Foreign Application Priority Data

Jun. 15, 1988 [DE] Fed. Rep. of Germany ... 8807794[U]

[51] Int. Cl.[5] ..... B02C 18/2

[52] U.S. Cl. ..... 241/55; 241/92; 241/101.7; 241/152 R

[58] Field of Search ..... 241/55, 56, 101.7, 92, 241/152 R, 152 A

[56] References Cited

U.S. PATENT DOCUMENTS 4,199,112 4/1980 McLean ..... 241/92
4,360,166 11/1982 Biersack ..... 241/92
4,593,863 6/1986 Mordstein et al. ..... 241/92

FOREIGN PATENT DOCUMENTS 253232 1/1988 European Pat. Off. ..... 241/101.7
1047588 12/1958 Fed. Rep. of Germany .
1298867 7/1969 Fed. Rep. of Germany .
3420165 12/1985 Fed. Rep. of Germany ... 241/101.7

*Primary Examiner*—Mark Rosenbaum
*Attorney, Agent, or Firm*—Richard J. Birch

[57] ABSTRACT

A chopping- and slicing machine for the crushing of bulky, hard or soft materials whereby these might also be dirtied by soil and stones. The machine has a system of blades that has sharp cutting blades in one direction of course and blunt cutting blades in the other direction of course.

11 Claims, 2 Drawing Sheets

CHOPPING- AND SLICING MACHINE

The invention relates to a chopping- and slicing machine, especially for the application in the garden for the chopping of materials to be composted.

When developing a machine for the crushing of garden waste that is to be composted, you are confronted with the problem that the materials to be crushed are of a totally different composition. On the one hand you should be able to chop wooden waste as e.g. branches. To this end you actually need a chopping machine that cuts the wooden parts which should be placed against a surface with a very sharp cutting tool into pieces.

But at the same time you should be able to crush in the chopping- and slicing machine materials like e.g. foliage, windfalls, carrots and similar materials that have a rather soft composition and have to be chopped. Then you are faced with another problem, namely that these latter materials are often dirtied by sand, small stones or soil. This dirt would very soon lead to a blunting of the cutting blades necessary for the wood processing if you used a normal chopping machine. On the other hand, blunt crushing blades are more suitable for an optimal slicing than sharp cutting blades.

Another difficulty reveals from the security requirements of DIN 11004 part 1 of March, 1989. According to this security regulations the inlets of the chopping machine are not allowed to fall below certain sizes or exceed a certain diameter, in order to avoid a reaching of the user into the running cutting blades by mistake. Here also emerge two different requirements. On the one hand the machine must certainly comply with the security regulations. On the other hand the handling of the machine should be as simple and the size of the machine as small as possible. This is also to prevent that the materials to be crushed have to be filled in by the user too far at the top. This leads to an unnecessarily hard manual work if the user has to shovel up the material to be processed to a height of about 1.60m above the soil which is necessary because of the security regulations. To this it was proposed to use a sidewise displaced cone, the inlet of which leads to a horizontally bended piece which again leads into the working chamber of the slicing machine so that a direct vertical reaching from above into the working chamber is no longer possible. Such installations are shown e.g. on the DE-AS 12 98 867, FIG. 2 or on DE-AS 10 47 588. Such a displaced inlet port is indeed very suitable for the processing of e.g. foliage, carrots or similar materials, but with branches there is the difficulty that they cannot be processed because of their bulkiness as they cannot be bended repeatedly around the corner. Thus it is the purpose of the invention to create a universal chopping- and slicing machine which is suitable for the processing of bulky branches as well as for leaves and waste dirtied by soil, stones or sand.

In order to solve this task, some kind of two-chamber system has been proposed. It is to have an upper chamber with a big inlet for the processing of garden waste which is soft and possibly dirtied by soil, sand or small stones whereas below there is planned a separated second chamber that has a short and small inlet for branches. In the upper chamber there are installed crushing- and cutting blades. This solution is basically the assemblage of a chopping- and a slicing machine which will then be drived by the same driving axle of the same engine. Accordingly, the machine is too big, has a superflous number of accessory parts and becomes thus too heavy and too expensive.

The present invention is, by contrast, a chopping- and slicing machine that has on the whole no additional parts compared with a simple chopping- or slicing machine and is therefore neither bigger nor heavier than such a machine.

It is new that for the solution of this problem blade systems are planned that have sharp cutting blades in the one direction of course and in the other blunt crushing blades. At the same time, a reversal of the propulsion's direction of course has to be planned. Then you have one direction of course for chopping and the other direction for slicing.

To grant an easier feeding of the material, an inlet cone full of corners may be planned in the feeding device for bulky and round materials whereby a small part of the machine's working chamber overlaps with the opening of the inlet cone in such a way that here emerges a straight feeding device with a small cross section for branches or similar bulky materials.

Further advantageous type models of the invention result from the enclosed sub-claims.

Moreover, further characteristics and advantages of the invention can be learned from the following description in connection with the enclosed drawings.

Figure 1:
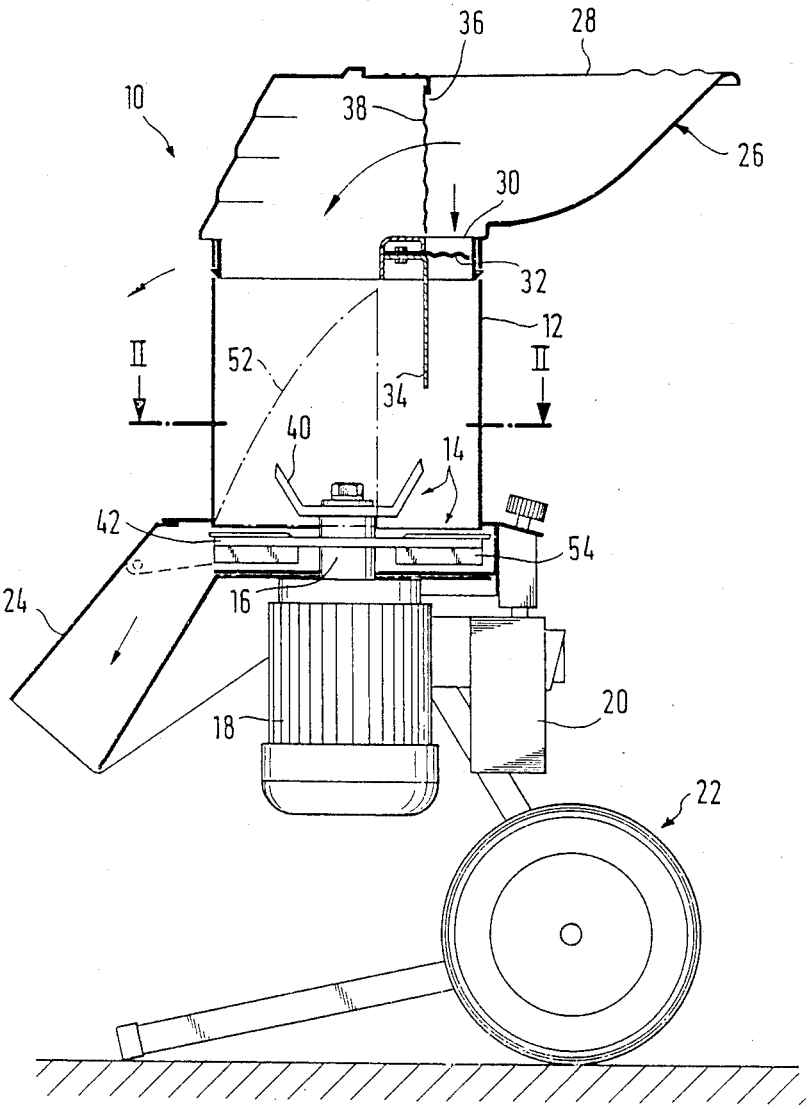
FIG. 1 shows a transverse section of a type model of the chopping- and slicing machine according to the invention. The section corresponds to line I—I in FIG. 2.
Figure 2:
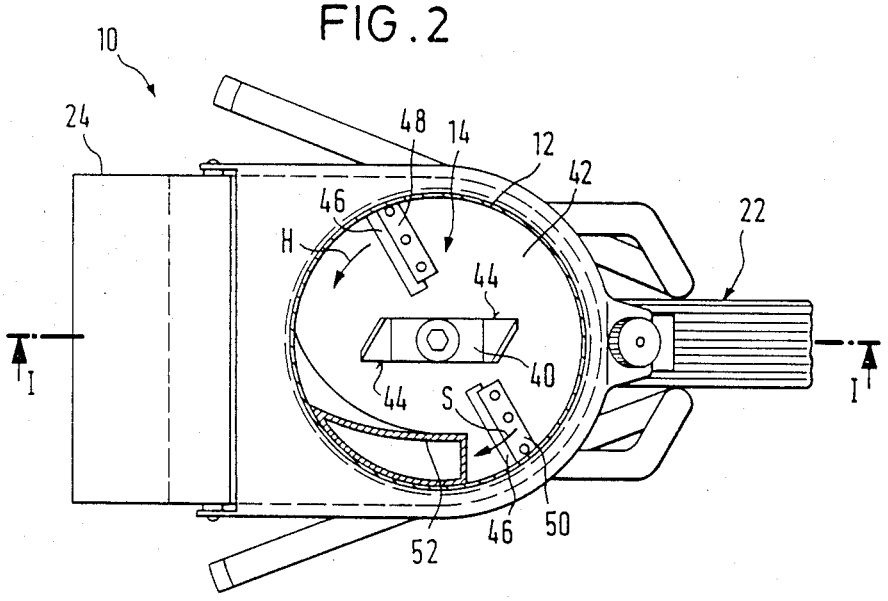
FIG. 2 shows a horizontal section alongside line II—II of FIG. 1.
Figure 3:
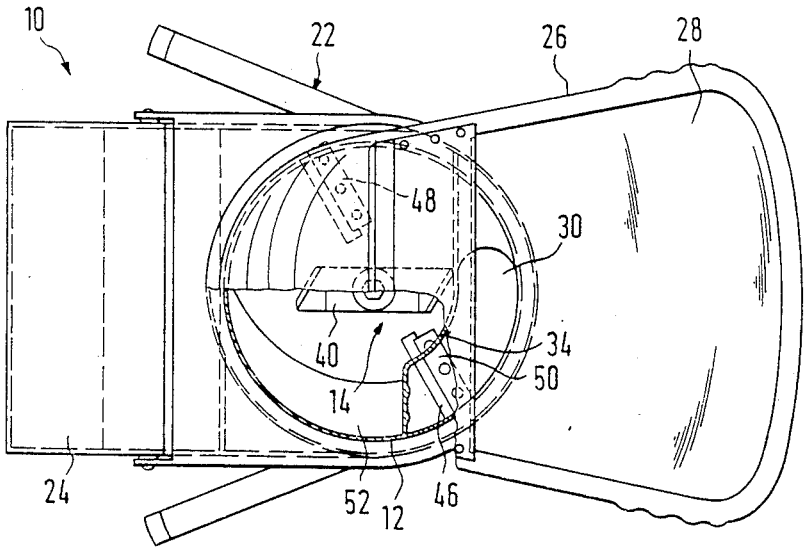
FIG. 3 shows a depiction of the above described model type, which is partly broken up.

A chopping- and slicing machine 10 according to the invention is shown on the FIGS. 1 to 3. It consists of a cylindrical chopping chamber 12 in which a set of blades 14 is installed directly above the bottom of the chamber on a shaft 16 that passes through the bottom of the chamber and is there connected with a drive motor 18. In this case the drive motor 18 is an electric motor as the course of direction of an electric motor is easier to switch. An electrical switching mechanism that has the usual circuit closer and breaker with a safety circuit breaker upon opening of the chopping chamber is attached to the motor. Here it is marked with the reference 20 and additionally contends a switch for the reversal of the direction of course of the drive motor 18. Of course, a propulsion of the machine with an internal combustion-engine is also possible. In this case there had to be planned a reversing gear instead of a switching mechanism.

In the case of the present model type example the whole chopping- and slicing machine is attached to a usual undercarriage 22 as usual for such machines.

At the opposite side of the electrical switching mechanism 20, the chopping chamber 12 has an inlet just above the soil by which the crushed material arrives at the outlet cone 24 that is tilted diagonally to the bottom by which it leaves the machine.

The breadth of the inlet and the outlet cone here corresponds to the breath of the chopping chamber 12.

On the chopping chamber open to the top is the inlet cone 26. The inlet cone extends at the side of the electrical switching mechanism approximately by the diameter of the chopping chamber 12 laterally beyond the chopping chamber. The inlet cone is on the whole in the area extending beyond the chopping chamber 12 open to the top whereas it is almost completely closed above the chopping chamber. Thus the inlet cone 26 forms an inlet 28 through which the materials to be crushed can be supplied. According to the invention, the cone has two inlets leading into the chopping chamber. A small inlet 30 is in the area in which—seen from above—the receiving inlet 28 overlaps with the chopping chamber 12. By this a small straight passage from the receiving inlet 28 into the chopping chamber 12 running vertically from the top to the bottom is formed. This inlet 30 might be equipped with a nonreturn valve 32 by which a throwing out of the crushed material through this opening may be avoided. Furthermore, a guide plate 34 is planned at the small inlet 30 that projects into the chopping chamber 12 to such an extend that through this plate and the wall of the chopping chamber 12 a film track is formed by the material to be crushed supplied through the inlet 30. The inlet has then the shape of a ring segment and the inner radius of the ring is larger than the radius the preliminary chopper (40) sweeps over. The guide plate (34) is attached to the running edge. Therefore, it has the shape of a circular segment.

Whereas the small inlet 30 shapes a vertically straight passage with a small cross-section of about 40mm together with the inlet 30 (in accordance with the respective safety regulations), the inlet cone 26 has a far bigger inlet 36 in the direction to the chopping chamber. This inlet is also closed by a nonreturn valve 38 in order to avoid the throwing out of crushed materials. It is in the right angle of the entrance direction of the inlet 28 and thus forms a two times angle-shaped passage into the chopping chamber. In accordance with the security regulations a passage of 250mm is planned for this inlet.

The set of blades 14 consists of a preliminary chopper 40 rotating above the opening of the outlet cone 24 and a crushing plate 42, which is attached at the same height as the outlet cone 24. At the same time the whole set of blades is rotating around the axle center of the cylindrical shape of the chopping chamber 12.

The preliminary crusher 40 is only used for chopping. It consists of a metal strip the edges of which are bent-up. The two performance edges 44 of the preliminary crusher are on the top right or down on the left. On the back, the final edges of the preliminary crusher are bevelled in order to form a setting angle for the performance edges. The crushing plate 42 has two slits 46 that are respectively planned for the passage of the chopped materials and will be bordered each by a blade at one side. A crushing blade 48 of the crushing plate 42, by contrast, is attached in such a way that it—seen from above—comes into effect counter-clockwise with the other direction of rotation. At the bottom on the crushing plate 42 there are attached tapping sheets 54 which almost extend to the bottom of the chopping chamber 12.

Moreover, the chopping chamber 12 contends a wedge gib 52 attached above the crushing plate. The situation of this wedge gib 52 is indicated in FIG. 1 by a dash- and dot-line as normally it could not be seen on the sectional drawing of FIG. 1 as it belongs to the invisible side. The wedge gib has an edge running radially to the crushing plate 42 and passing vertically through the top edge of the crushing chamber 12. The breadth of the edge remains the same. On the opposite side of the edge the wedge gib runs acute-angled alongside the crooked wall to the chopping chamber. As a result, the wedge gib 52 becomes increasingly shorter at the top so that the wedge angle becomes upwards obtuser. In the following the functioning of the chopping- and slicing machine will be described. Here you have to make a difference between two methods of operation namely the chopping and the slicing operation. Seen from above the set of blades 14 runs counter-clockwise in accordance with the arrow designated as H in FIG. 2. The material to be chopped is filled in by the user into the receiving inlet 28 of the inlet cone 26. It passes through the inlets 30 and 36 into the chopping chamber 12. Very big pieces as e.g. cabbage heads, carrots or similar materials of course only pass through inlet 36. In the chopping chamber 12 the materials to be chopped are firstly picked up by the preliminary crusher 40. The wedge gib 52 thereby causes that the materials being in the chopping chamber rotate not only with the rotational speed of the set of blades but also get a lateral relative motion to the blades as the wedge gib 52 presses the materials to be crushed against the preliminary crusher 40. The preliminarily crushed material then passes through the slits 46 and arrives under the crushing plate 42. At the same time it is being crushed further by the crushing blade 48. Finally the crushed material passes through the tapping sheets 54 into the outlet cone 24 and through this leaves the machine.

The slicing operation serves to the crushing of bulky, wooden materials as e.g. branches and similar materials. In this method of operation the set of blades 14 runs clockwise in accordance with the arrow designated as S in FIG. 2. As the bulky material cannot enter through the repeatedly bended feeding inlet 36 it will be feeded by the straight passage that is bordered by the small inlet 30 and the small film track shaped by the guide plate 34. Through this the bulky material passes the preliminary crusher 50 and arrives directly at the crushing plate 42. As regards the direction of rotation for the slicing operation, the cutting blade 50 of the crushing plate 42 is brought into action. It then interacts in a particularly advantageous way together with the radial edge of the wedge gib 52. The lower end of this edge interacts namely together with the cutting blade 50 of the crushing plate 42 like a pair of scissors and cuts clean parts from the branches. The cut pieces again pass through the slits 46 under the crushing plate 42 and will then be conveyed from the tapping sheets 54 into the outlet cone 24. Through this outlet cone they leave the machine.

Instead of the crushing plate 42 described in the example of operation you can also use a blade log or a polygonal plate for instance shaped as a triangle. On this blade carriers the crushing and cutting blades have to be attached in the respective direction of rotation.

I claim:

1. A combined chopping and shredding machine with an inlet each for the material to be chopped and the material to be shredded, with a crushing chamber containing the material to be crushed which is equipped with a cutting and crushing device as well as an electric drive unit which rotates the crushing device, and a lateral outlet funnel through which the material centrifugally exits after it has been crushed, characterized in that the material is fed in via one funnel (26) which is suited for feeding in both hard and soft crushing material and has a receiving inlet (28) which is laterally displaced in relation to the crushing chamber (12), said crushing chamber (12) having a small straight passage which is formed by the receiving inlet (28) and a small inlet (30) parallel to the receiving inlet and a wide angular passage which can be fed by the receiving inlet (28) and a big inlet (36) which is perpendicular to the receiving inlet, and that the crushing device comprises a set of blades (14) with blade beaters (40, 48) for chopping which are mounted in one direction of rotation and blade cutters (50) for shredding which are mounted in the opposite direction of rotation and a drive unit (18) with reversible direction of rotation and that the drive unit (18) is driven directly.

2. Chopping and shredding machine according to claim 1, characterized in that the set of blades (14) comprises an above installed preliminary crusher (40) for crushed materials with striking edges (44) and a crushing plate (42) with slits (46) installed below to which the cutting and crushing blades (48, 50) are attached.

3. Chopping and shredding machine according to claim 2 characterized in that tapping sheets (54) are installed at the bottom of the crushing plate (42) which almost reach to the bottom of the crushing chamber (12).

4. Chopping and shredding machine according to claim 1, 2 or 3 characterized in that the drive unit (18) is an electric motor with an electrical switching mechanism (20) for a changing of the direction.

5. Chopping and shredding machine according to claim 1 or 2, characterized in a wedge (52) which is fastened at the inner sidewall of the chopping chamber above the crushing plate (12) and has against the direction of rotation an edge running radially to the interior for slicing that extends to the same breadth up to the upper edge of the chopping chamber and which runs against the direction of rotation for chopping which tapers to a pointed angle whereby the length of the wedge gib (52) decreases so that it runs to the top with an increasingly pointed angle.

6. Chopping and shredding machine according to claim 5, characterized in that the radial edge of the wedge gib (52) is below the edge in the direction of rotation for chopping under the smaller inlet (30).

7. Chopping and shredding machine according to claim 5, characterized in that the smaller inlet (30) on the whole has the shape of a ring segment, the inner radius of the ring segment being larger than the radius the preliminary crusher (40) sweeps over.

8. Chopping and shredding machine according to claim 7, characterized in that a guide plate (34) is attached to the inner edge of the smaller inlet (30) that extends vertically to the bottom.

9. Chopping and shredding machine according to claim 1 characterized in that the inlets (30, 36) are closed by nonreturn valves (32, 38).

10. Chopping and shredding machine according to claim 1, characterized by the fact that the set of blades (14) comprises a preliminary crusher (40) with striking edges (44) installed at the top for materials to be chopped.

11. Chopping and shredding machine according to claim 1, characterized by the fact that the set of blades (14) comprises an above installed preliminary crusher (40) with striking edges (44) installed at the top for materials to be crushed and a plate (42) installed underneath at which the cutting and crushing blades are installed.

* * * * *